United States Patent [19]

Kelson

[11] 4,239,006

[45] Dec. 16, 1980

[54] SELF LUBRICATING SABOT

[76] Inventor: Richard D. Kelson, 6074 Wending La., Hunter, Utah 84120

[21] Appl. No.: 928,512

[22] Filed: Jul. 27, 1978

[51] Int. Cl.[3] ..... F42B 13/16

[52] U.S. Cl. ..... 102/93; 102/38 WR; 102/92

[58] Field of Search ..... 102/38 WR, 92, 93

[56] References Cited

U.S. PATENT DOCUMENTS

| | | | |
|---|---|---|---|
| 1,039,774 | 10/1912 | Melanda | 102/92 |
| 2,306,140 | 12/1942 | Reed | 102/93 |
| 2,983,224 | 5/1961 | Prosen et al. | 102/93 X |
| 2,996,992 | 8/1961 | Critchfield et al. | 102/93 |
| 3,311,061 | 3/1967 | Roehidang | 102/93 |
| 3,356,029 | 12/1967 | Seidel | 102/92 |
| 3,398,682 | 8/1968 | Abela | 102/93 X |
| 3,427,648 | 2/1969 | Manning et al. | 102/93 |

FOREIGN PATENT DOCUMENTS

| | | | |
|---|---|---|---|
| 18514 | of 1904 | United Kingdom | 102/92 |

*Primary Examiner*—Harold J. Tudor

*Attorney, Agent, or Firm*—Thorpe, North, Western & Gold

[57] ABSTRACT

Sabots for modern firearms, including both rifles and pistols, which have reduced friction thus imparting greater sub-caliber projectile velocity are made from a thermoplastic resin containing finely divided solid lubricant fillers. Preferably the forward end of the sabot is tapered to further reduce friction and improve cartridge feeding in automatic firearms.

6 Claims, 3 Drawing Figures

SELF LUBRICATING SABOT

BACKGROUND OF THE INVENTION

This application relates to new and improved sabots which have reduced friction and can be fired at higher velocities. More specifically this invention relates to thermoplastic sabots containing a solid lubricant filler which reduces friction between the sabot and the bore of the firearm through which it is fired.

There is much literature regarding the use of plastic sabots in rifled firearms and particularly rifles. In general these sabots are deformable and act as a sealant to prevent gases from leaking out the barrel ahead of the bullet and sabot. These gases, resulting from the firing of a cartridge, propel the sub-caliber bullet forward with greater velocity than they do a full caliber bullet. Various types of plastics have been used such as polycarbonates, polyamides (nylons), fluorocarbons, acrylic polymers, acetal resins and polyalkylene polymers such as high density polyethylene.

Prior art sabots are generally cylindrical in shape with the front and back ends being of substantially the same diameter and containing blunt ends. The front portion of the sabots are generally scored or contain external grooves or other devices to weaken the sabot structure. The air resistance against the blunt forward end of the rotating sabot and the centrifugal force exerted on it as it emerges from the firearm barrel causes the sabot to rupture at the weakened areas thus releasing the projectile. Typical sabots having these characteristics are taught in U.S. Pat. Nos. 2,820,412; 3,005,804; 3,141,412; 3,164,092; 3,186,342 and 3,317,061.

In police work and other types of protective activities, it is often necessary to utilize armor piercing projectiles. It would be desirable to be able to fire such projectiles from pistols. Such materials as case hardened steel are desired projectiles but a full caliber projectile made of such hardness would soon score the lands and ruin the riflings within a gun barrel. It is also desirable to obtain maximum velocity when firing such projectiles. It is known that such hardened projectiles can be fired from a rifle in sub-caliber form using a sabot to optimize velocity without building up gas pressures that would be harmful to the firearm or the shooter and to avoid damage to the riflings. However, projectiles fired from prior art plastic sabots are somewhat slowed in the barrel due to friction and are further slowed by the wind resistance encountered at the blunt foreward end of the sabot after it emerges from the muzzle of the firearm but before separation of the bullet from the sabot. The blunt end of the prior art sabots also create a problem in that they often interfere with the loading mechanism of the firearm causing it to jam.

BRIEF DESCRIPTION OF THE INVENTION

It is an object of the present invention to provide a self-lubricating plastic sabot which maximizes the projectile velocity.

It is also an object of the present invention to provide a plastic sabot which has minimum wind resistance but which readily separates from the bullet or projectile after leaving the muzzle of the firearm.

Another object of the present invention is to provide a plastic sabot that is suitable for use in both rifles and pistols.

Still another object of the invention is to provide a sabot which, when inserted into a cartridge, will be readily loaded from a magazine or clip into the firing chamber of a firearm without causing the feeding mechanism to jam.

These and other objects may be accomplished by means of a sabot made from a thermoplastic polymer in which has been dispersed a finely divided solid lubricant such as molybdenum disulfide or graphite. The sabot is cylindrical in shape consisting of a thermoplastic-solid lubricant sleeve having a closed end at the rear of the projectile. The outside end portion is flat but the inside portion may be shaped so as to abut all or only a portion of the end of the projectile. In other words, there may be an air space in the sabot rearward of the projectile. The forward portion of the sabot preferably tapers gradually inwardly toward the open end of the sleeve. The sleeve portion of the sabot contains equidistantly radially spaced longitudinal slots beginning at the forward open end which may vary in length from the length of the tapered portion to the full length of the internal cavity formed by the sleeve.

Upon the discharge of a cartridge containing a gradually tapered lubricated sabot, the sabot and projectile pass through the barrel with minimum friction due to the solid lubricant dispersed within the plastic and the reduced surface area of the sabot caused by forward tapering of the sabot sleeve. There is sufficient friction between the bore riflings and the sabot to cause the sabot and projectile to rotate in the normal manner. Upon leaving the muzzle the centrifugal force upon the sabot created by the riflings causes the slotted portions of the sabot sleeve to flare outwardly wherein wind resistance causes a separation of the sabot from the projectile which continues on to its target with enhanced velocity.

Further advantages of the invention and a more particular explanation thereof will be found in the drawings and the following detailed description.

DETAILED DESCRIPTION OF THE INVENTION

Figure 1:
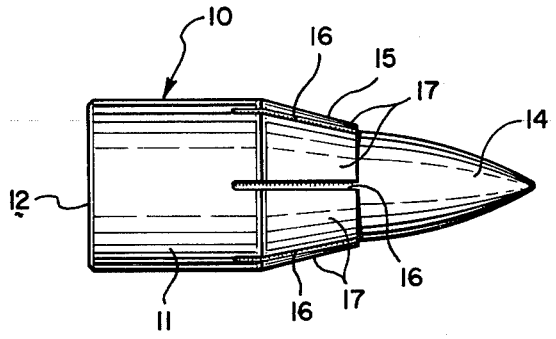
FIG. 1 is a perspective side view of a sabot which has been slotted and tapered at its forward end containing a projectile.
Figure 2:
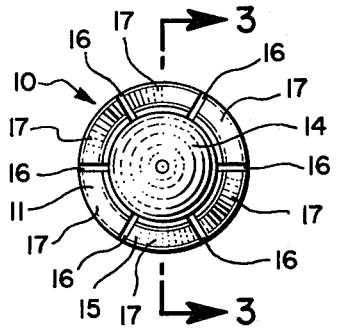
FIG. 2 is a perspective end view of the sabot shown in FIG. 1.
Figure 3:
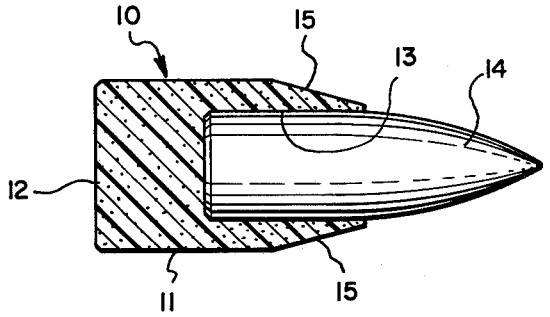
FIG. 3 is a side sectional view of a sabot taken along lines 3—3 of FIG. 2.

There is shown in FIGS. 1-3 a complete operative embodiment of the invention. The sabot 10 contains a cylindrical sidewall or sleeve 11 closed at the rear end 12 forming a cylindrical internal cavity 13 into which is inserted a projectile 14. Preferably the cavity 13 has a diameter about one thousandth of an inch smaller than the projectile 14 so that the projectile can be securely held within the cavity by friction. Although the sabot is made of a thermoplastic having dispersed therein a solid lubricant, the friction between the projectile 14 and the walls of cavity 13 is still great enough that the projectile will rotate with the sabot and not slip while passing through the riflings of the bore.

The forward portion 15 of the sabot is gradually tapered so as to enable a loaded cartridge to be readily transferred from a magazine or clip into the firing chamber of a firearm. The gradual tapering of the sabot is especially important for automatic firearms where it results in smoother and more positive feeding. The forward end of the sabot is also gradually tapered to lessen wind resistance and present reduced surface area to the lands of the rifled bore. By gradual tapering is means the angle of taper is not abrupt and will not exceed an angle of 45°. Preferably the angle of taper will be between 15° and 35°. The sabot contains slots 16 equidistantly radially spaced around the perimeter of the cavity extending axially backwardly along the sleeve 11 a predetermined distance. Slotss 16 may vary in length from the length of the taper 15 to the length of the internal cavity 13. The slots 16 divide that portion of the sleeve 11 into fingers 17.

In operation the combined sabot-projectile pass through the bore of the barrel with minimal friction gaining both velocity and high rotational speed. The wind resistance on the sabot upon leaving the muzzle is minimal due to the tapered portion 15 of the sleeve 11. However, the centrifugal force causes the fingers 17 to flare outwardly thereby meeting wind resistance and slowing the plastic sabot. The lubricated plastic allows the projectile 14 to be quickly separated from the sabot and fly on to its target at maximum velocity.

The plastic used in making the sabot is important to its correct functioning. The sabot must be sufficiently deformable to seal the bore and prevent gases from the exploded cartridge seeping past the sabot. At the same time it has been found that better performance is obtained using plastics having increased strength and rigidity and a low coefficient of friction. It has been found that the addition of a solid lubricant to a thermoplastic increases the tensile strength, and modulus of plasticity. The sabot preferably has a diameter slightly greater than the diameter of the bore through which it is to pass. The lower coefficient of friction possessed by plastic containing a solid lubricant allows passage of the sabot through the lands of the bore with minimum resistance while at the same time still causing rotation of the sabot by the riflings in the bore.

Several unlubricated thermoplastic resins were tested including a polyamide (Polypenco's Nylon 101), an acetal resin (DuPont's Delrin), a tetrafluoro-ethylene resin (DuPont's Teflon) and a polycarbonate resin (General Electric's Lexan) with the polyamide nylon showing best results.

Two types of nylon were obtained containing dispersed particles of molybdenum disulfide lubricant (Polypenco's Nylatron GS and Nylatron GSM) and when compared with Nylon 101 showed superior results. Physical properties of the three nylon resins are as follows:

| Property | ASTM Method | Nylon 101 | Nylatron GS | Nylatron GSM |
|---|---|---|---|---|
| Tensile Strength PSI | D-638 | 9,000-12,800 | 10,000-14,000 | 11,000-14,000 |
| Modulus of Elasticity PSI | D-638 | 250,000-400,000 | 450,000-600,000 | 350,000-450,000 |
| Deformation % | D-6-1 | 1.0-3.0 | 0.5-2.5 | 0.5-1.0 |

It can be readily seen from the above table that the nylons containing the solid lubricant filler were greater in strength, higher in rigidity and more resistant to deformation under load than the non-filled nylon.

Conditions and variables effect the coefficient of friction of nylons. Because of variables such as temperature, humidity, speed, load, surface finish of sabot and bore and diameter of sabot compared with diameter of bore the coefficient of friction is difficult to predict. However, based on operating data the coefficient of friction of unlubricated nylons against a mating surface of unlubricated steel will vary from about 0.1 to 0.6 with ranges from 0.2 to 0.25 being most common. On the other hand lubricated nylons generally have a coefficient of friction between about 0.02 to 0.10.

Although sabots made from nylon resins containing a solid lubricant showed best results, other thermoplastic resins including polycarbonates, acetal resins, fluorocarbons, acrylic resins, polyolefins, polyaromatic resins, vinyl resins and the like which contain a dispersed solid lubricant are considered to be within the scope of the present invention.

While the above constitutes a preferred embodiment of the invention it is to be understood that various modifications and changes may be made without departing from the scope thereof.

I claim:

1. A unitary one piece plastic sabot for projection through a rifled gun barrel which sabot is constructed from a nylon resin having dispersed particles of a solid lubricant throughout, said sabot consisting of a cylindrical sleeve having a back imperforate closed end and an open forward end defining a cylindrical projectile cavity said sleeve tapering gradually inwardly from a predetermined point on said sleeve to the forward end thereof and containing a plurality of equidistantly radially spaced slots extending axially from said open forward end a predetermined distance, said distance being less than the length of the cavity and at least as great as the lengths of the tapered portion of the sleeve.

2. A unitary plastic sabot according to claim 1 wherein the solid lubricant is a member selected from the group consisting of molybdenum disulfide and graphite.

3. A unitary plastic sabot according to claim 2 wherein the angle of taper does not exceed 45°.

4. A unitary plastic sabot according to claim 3 wherein the solid lubricant is molybdenum disulfide.

5. A unitary plastic sabot according to claim 3 wherein the solid lubricant is graphite.

6. A unitary plastic sabot according to claim 3 wherein the angle of taper is between about 15° and 35°.

* * * * *